US010011965B2

(12) United States Patent
Lipscomb

(10) Patent No.: US 10,011,965 B2
(45) Date of Patent: Jul. 3, 2018

(54) PRODUCTION AND APPLICATION OF FIRE RESISTANT EROSION CONTROL MAT

(71) Applicant: Chad M. Lipscomb, Woodland, CA (US)

(72) Inventor: Chad M. Lipscomb, Woodland, CA (US)

(73) Assignee: Western Excelsior Corp, Evansville, IN (US)

( * ) Notice: Subject to any disclaimer, the term of this patent is extended or adjusted under 35 U.S.C. 154(b) by 0 days.

(21) Appl. No.: 15/330,240

(22) Filed: Aug. 26, 2016

(65) Prior Publication Data

US 2017/0121922 A1 May 4, 2017

Related U.S. Application Data

(60) Provisional application No. 62/283,276, filed on Aug. 26, 2015.

(51) Int. Cl.
*E02D 17/20* (2006.01)
*E02B 3/12* (2006.01)

(52) U.S. Cl.
CPC ..... *E02B 3/122* (2013.01); *E02B 3/126* (2013.01); *E02D 17/202* (2013.01); *E02D 2200/13* (2013.01); *E02D 2300/0051* (2013.01)

(58) Field of Classification Search
CPC . E02B 3/12; E02B 3/122; E02B 3/123; E02B 3/124; E02D 17/20; E02D 17/202
USPC ..... 405/15–17, 19, 302.4, 302.6, 302.7
See application file for complete search history.

(56) References Cited

U.S. PATENT DOCUMENTS 2,192,939 A * 3/1940 Slayter ..... E02D 17/20 111/200
4,655,637 A * 4/1987 Vignocchi ..... E02B 3/12 405/15
7,384,217 B1 * 6/2008 Barrett ..... E02D 17/20 405/15
2004/0005198 A1 * 1/2004 Spangler ..... E02B 3/04 405/302.6

FOREIGN PATENT DOCUMENTS

CN 103924606 A * 7/2014

OTHER PUBLICATIONS

Translation of the Abstract of CN 103924606A Jul. 2014, 2 pages.*

* cited by examiner

*Primary Examiner* — Sunil Singh
(74) *Attorney, Agent, or Firm* — Don Halgren

(57) ABSTRACT

A fire resistant ground erosion control mat assembly. The mat assembly includes an inner layer of fire resistant milled stone mineral wool material with an upper and a lower layer of supportive nets. Each of the upper and lower nets consist of fire resistant milled mineral foraminous nettings to enable passage of light and water therethrough as a ground positioned emplacement of the inner layer.

2 Claims, 3 Drawing Sheets

PRODUCTION AND APPLICATION OF FIRE RESISTANT EROSION CONTROL MAT

BACKGROUND OF THE INVENTION

Field of the Invention

The present invention relates to a construction of a fiber matrix utilized for the protection of surface soils, subsurface soils, turf and vegetation typically disturbed by construction activities or eroded by the forces of falling and flowing water. Such fiber matrix may be identified as a permanent Rolled Erosion Control Product (RECP), termed a Turf Reinforcement Mat (TRM), which mat is utilized in conjunction with the vegetation to form a permanent, systemic installation that reinforces that vegetation, improving the overall resistance to nature's hydraulic forces and is based upon Provisional Application No. 62/283,276, filed 26 Aug. 2015, and incorporated herein by reference in its entirety.

Discussion of the Art

Disturbed ground is usually repaired and protected by the incorporation of natural vegetation on the site. However, in many cases, the accelerated or concentrated flow or steepened slopes caused by human development increases the forces of erosion, leaving the vegetation unstable. In these cases, a permanent Rolled Erosion Control Product (RECP), termed a Turf Reinforcement Mat (TRM), is used in conjunction with the vegetation to form a permanent, systemic installation that reinforces the vegetation, improving the overall resistance to hydraulic forces.

Uncontrolled erosion has an enormous impact on our environment, our water sources and on its maintenance and supply for agriculture resources and or maintenance and support of wildlife. Such effects have cost billions of dollars each year trying to manage or correct for those deleterious effects. Channels and waterways become filed with sediment, shorelines may be lost, and fertilizers may collect in water supplies to poison such water. Much of this may be irreversible. The use of RECPs, TRMs and sediment control barriers have become standard practice in the efforts to reduce polluted runoff into natural waterways and water supplies.

As a means to produce TRMs, a number of technologies have been developed and successfully deployed. Of this multitude of construction techniques, three stand out as the most widely adopted. These three technologies have been used more often and with more success than others.

The first of such technologies comprises stitch bonded, fiber matrix products which also serve as the most common technology. This method utilizes fiber that is chopped or cut, straight or crimped, and is placed atop a netting material as it proceeds down an assembly line. A second net is placed atop the fiber fill. The sandwiched arrangement travels further down the assembly line and is sewn by parallel stitching. The stitching secures the layers together and integrates the components into a single material. All of the component materials, fibers, netting and stitching, are typically comprised of a polyolefin, polyester, or polyamide. The finished product is rolled and delivered to the project site in a roll. On site, the material is unrolled over bare, prepared, seeded ground and secured with metal fasteners of varying type and properties.

The vegetation establishes through the mat, protecting the mat from sunlight (the degrading factor of the mat), while the mat protects the bare ground between the vegetation stems and protects the individual plant.

In sum, the composite of the human-formed material and natural vegetation yields a system greater than the sum of the components. This final system is permanent and able to withstand greater hydraulic forces than either component alone. One such technology is described in U.S. Pat. No. 7,820,560, with the patent protection afforded to the cross sectional shape of the fiber. An additional example of this technology is demonstrated in U.S. Pat. No. 5,849,645, which patents a particular type of advantageous netting.

A second technology exists that utilizes no netting, rather melt bonded or welded synthetic fibers. Long fibers are produced in a planar arrangement and heated to a temperature sufficient to melt-bond the individual fibers into a continuous, porous form. These mats have an advantage in a lack of netting, which can snag mowers or entrap wildlife. However, melt bonded products lack the inherent strength the netting provides. The product is produced into rolls and delivered and deployed in the same manner as stitch bonded products.

A third principle technology is a woven material. Specific weaving processes and techniques are utilized to create loft in the fabric, and thus, a three-dimensional web of protection for the vegetation. This class of products is created by weaving yarns into a continuous web. This arrangement yields the strongest, highest performing and longest lasting product class. Varieties of weave patterns, yarn types and treatments (heat shrinkage to form greater loft) have been utilized. An example of one such technology is cited in U.S. Pat. No. 5,567,087.

In order for a material to be classified as a permanent RECP, the material must maintain a permanent footprint and incorporate a measurable thickness of 0.25 inches (13 mm). As such, biodegradable or otherwise degradable components may not be utilized in the fabrication of TRM.

One significant problem with the prior art is the potential for ignition when the ground cover mat is exposed to heat or flame. The families of synthetic materials utilized for TRMs are not fire resistant. Chemical additives can improve the ignition resistance, however, such additives typically reduce the product's lifespan when exposed to sunlight. Even the few technologies that offer flame and ignition resistance and are UV stable offer little true resistance, in practical terms. When installed in roadside channels or on roadside slopes, particularly in arid climates, extreme temperatures, drought and plentiful ignition sources are cause for concern. Additionally, placement near important structures is dangerous, as the TRM adds a close-proximity fuel source, in the event of a wildfire, structure fire or other fire.

It is the object of the present invention to overcome the critical failures of current and past technologies while maintaining hydraulic and turf reinforcement performance.

It is a further object of the present invention to provide a finished product that is porous to allow for the growth of vegetation through the product.

It is a further object of the present invention to provide a mat that is flexible and conforms to the ground surface when installed.

It is a further object of the present invention to provide fiber and yarn with significantly greater specific gravity (~2.7) rather than typical synthetic fibers and yarns (~0.9).

It is a further object of the present invention to provide component fiber and yarn for the creation of mats/blankets that provide greater resistance to tensile loading, compared to synthetic fibers and yarn (strain rate).

It is a further object of the present invention to provide fiber derived components immune to decay from exposure to ultraviolet radiation, moisture, biologic activity, rot, mold or mildew.

It is a further object of the present invention to deploy an effective ignition, flame, smolder and fire resistant layer that provides erosion control in a cost effective manner.

It is a further object of the present invention to deploy an effective ignition, flame, smolder and fire resistant layer that provides turf reinforcement in a cost effective manner.

It is a further object of the present invention to provide a product that is easy to install, similar in means to conventional technologies.

It is a further object of the present invention to provide a product that is non-synthetic, in essence, natural, that meets the criteria qualify as a TRM.

It is a further object of the present invention to provide a product that is not derived from petrochemicals.

It is a further object of the present invention to provide an ignition, flame or fire resistant mat that may alternatively be used to protect the ground surface or other surface from flame, fire or ignition.

It is a further object of the present invention to provide an ignition, flame or fire proof mat that may alternatively be used to protect the ground surface or other surface from flame, fire or ignition.

It is a further object of the present invention to provide a component to a wildfire buffer system incorporating soil, the product and vegetation.

BRIEF SUMMARY OF THE INVENTION

The present invention utilizes fire resistant mineral wool "W", also known as for example, stone wool, rock wool, slag wool and glass wool, fiber and yarn, as a replacement for the typical synthetic components of a turf reinforcement mat. Such fibers are derived from mineral (rock, stone, ceramic) or similar sources that are used in the insulation and other temperature treatment industries. The fibers are created in an industrial process by milling mineral particles to small fibers in a treatment chamber. The small fibers are pressed into various forms including: blocks, strips and bulk, loose fiber, etc. From this source material, a number of useable componentry can be produced. Each component may act as a fire-resistant substitute for synthetic material components. Examples of such include: a source fiber "F" which is processed into longer fiber by spinning, extrusion, melting/cooling, or other means. This longer fiber may replace the chopped fiber fill in conventional stitch-bonded products, by a grinding or milling roll arrangement so as to become a usable length of inner layer material. Those usable lengths of fire-resistant fiber may be deposited as the inner layer on a fire-resistant lower web, and covered with an upper fire-resistant web from a supply roll, for production of a fire-resistant mat, after passing through a proper treatment works, such as an oven, wherein subsequently, treatment rollers and binder application are provided. The upper and lower webs in further embodiments may be comprised of for example, a wire mesh, synthetic extruded netting or synthetic yarn or a combination thereof, woven into a net. Such components are preferably but not necessarily fire resistant, for one particular embodiment, inasmuch as they initially contain and secure the inner layer for a sufficient length of time to establish proper ground positioning of the mat.

The source fiber may be spun or otherwise processed into long yarns and used to replace the thread in a fire-resistant stitch bonded product. The source fiber may be spun or processed into long yarns and woven into a net that is utilized as a replacement for the netting, on the stitch bonded product. The source fiber may be spun into long yarns entangled or wrapped in conjunction with other components (steel mesh, synthetic mesh, etc) to form advantageous configurations of mats. The source fiber may also be spun into long yarns woven into a continuous matrix or web that forms a three-dimensional array, absent fiber and stitching or inclusive of fiber and stitching.

Further, such layered nets may be bound into the tethered layers by stitching, spot welding, adhesiving or stapling to confine the fiber matrix "F" between the nets.

Alternatively, in further embodiments, such fiber matrix may be formed without either or both the upper and lower nets, by an adhesive binder, a thermoplastic resin, a heat welding, tack welding or heat treatment of the fibers "F" for insuring tacked fiber adhesion of the milled mineral wool or metallic wool (for example, steel wool) to one another at disparate locations thereon sufficient to form a flexible, ground-depositable layer of fire resistant, ground erosion-minimizing protection, with or without either or both the upper and/or lower layer of fire-resistant or synthetic, or eventually degradable enclosure nets.

The fibers and yarns are preferably thicker and longer than the source fiber of the parent mineral wool. Dimensions may vary, however, are sufficient to develop a matrix, yarn or fiber to meet specification. Typically, the fill fiber has dimensions ranging from 0.01 inches to 0.1 inches thick and from 0.25 inches up to 12 inches in length. The finished yarn preferably ranges from 0.01 inches to 0.75 inches thick and from a few inches to tens of thousands of feet long.

The invention thus comprises a fire resistant ground erosion control mat assembly comprised of an inner layer of fire resistant milled stone mineral wool material with an upper and a lower layer of supportive nets, wherein each of the upper and lower nets consist of fire resistant milled mineral foraminous nettings to enable passage of light and water therethrough as a ground positioned emplacement of the inner layer. The milled stone mineral wool material preferably consists of Basalt rock. The upper layer, the lower layer and the inner layer of the assembly is light transmissive. The light transmissive mat assembly has a light projection analyzable open area from 30 to 80 percent. The upper and lower layers may consist of a chain link webbing. The inner layer consists of mineral wool fibers preferably between 1 to 8 inches long and between 0.005 to 0.05 inches in diameter. The fire resistant ground erosion control mat assembly comprised of an inner layer of fire resistant milled stone mineral wool material with an upper and a lower layer of supportive nets, wherein each of the upper and lower nets consist of fire resistant milled mineral foraminous nettings to enable passage of light and water therethrough as a ground positioned emplacement of the inner layer, and wherein the milled stone mineral wool material consists of Basalt rock, wherein the upper layer, the lower layer and the inner layer of the assembly is light transmissive, wherein the light transmissive mat assembly has a light projection analyzable open area from 30 to 80 percent, wherein the upper and lower layers are comprised of a chain link webbing, and wherein the inner layer is comprised of mineral wool fibers between 1 to 8 inches long and between 0.005 to 0.05 inches in diameter.

The invention also comprises a fire resistant ground erosion control mat comprised of: an inner layer of fire resistant metallic wool material having an upper and a lower layer of supportive nets comprised of fire resistant milled mineral wool or of various erodible nettings sufficient to establish ground positioned emplacement of the inner layer.

BRIEF DESCRIPTION OF THE DRAWINGS

The objects and advantages of the present invention will become more apparent when viewed in conjunction with the following drawings, in which.

DETAILED DESCRIPTION OF THE PREFERRED EMBODIMENTS

Figure 1:
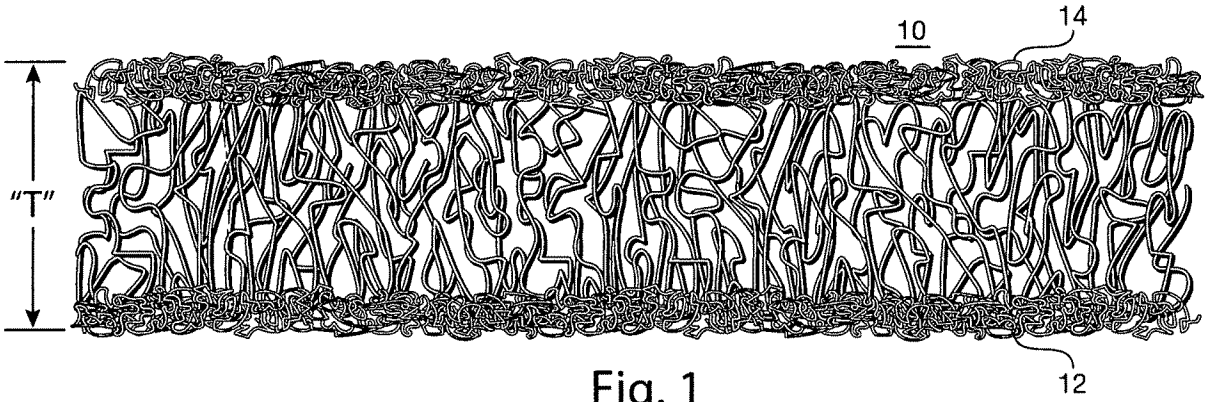
FIG. 1 is an edge view of a multi-layered fire resistant erosion control mat constructed according to the principles of the present invention.

Referring now to the details of the drawings, the present invention as shown in FIG. 1 comprises an elongated, flexible, fire-resistant, multi-layered mat 10 comprised of an elongated, fire resistant lower netting 12, an elongated fire resistant upper netting 14 and an elongated, fire-resistant, light and air-penetrable inner layer 16.

Figure 2:
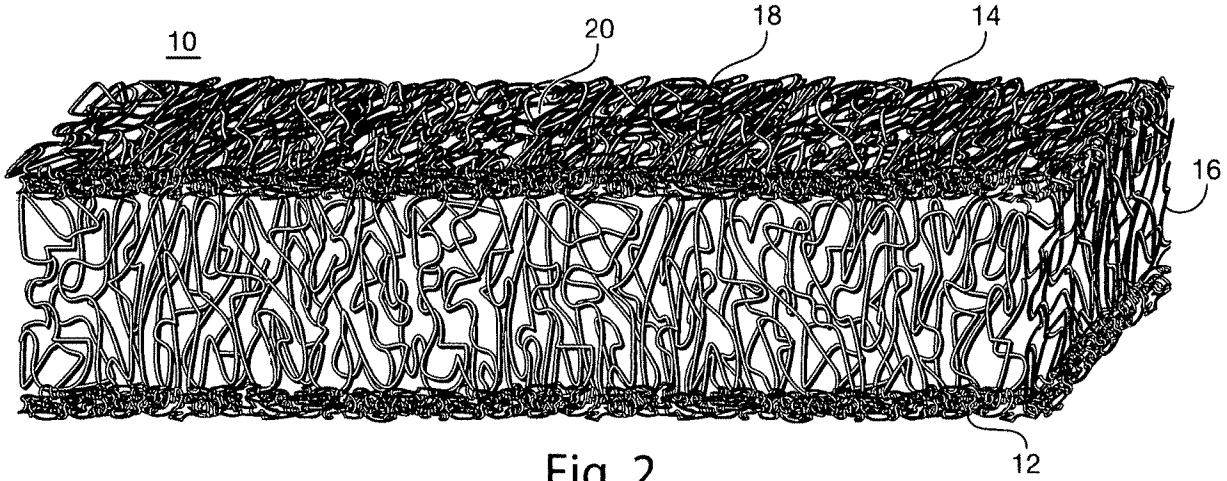
FIG. 2 is a perspective view of the multi-layered fire resistant erosion control mat represented in FIG. 1.

The elongated, flexible, fire-resistant lower netting 12 is preferably comprised of a web of woven or roll-pressed or stamped, porous or foraminous, air and light transmissive layer of metal such as stainless steel, galvanized steel, aluminum, tin, or a fire resistant plastic or polyvinyl chloride material, as represented in FIGS. 1 and 2. Such lower netting 12 may also be comprised of a chain link type arrangement, having smaller openings of a range of one quarter inch to one inch across.

Figure 3:
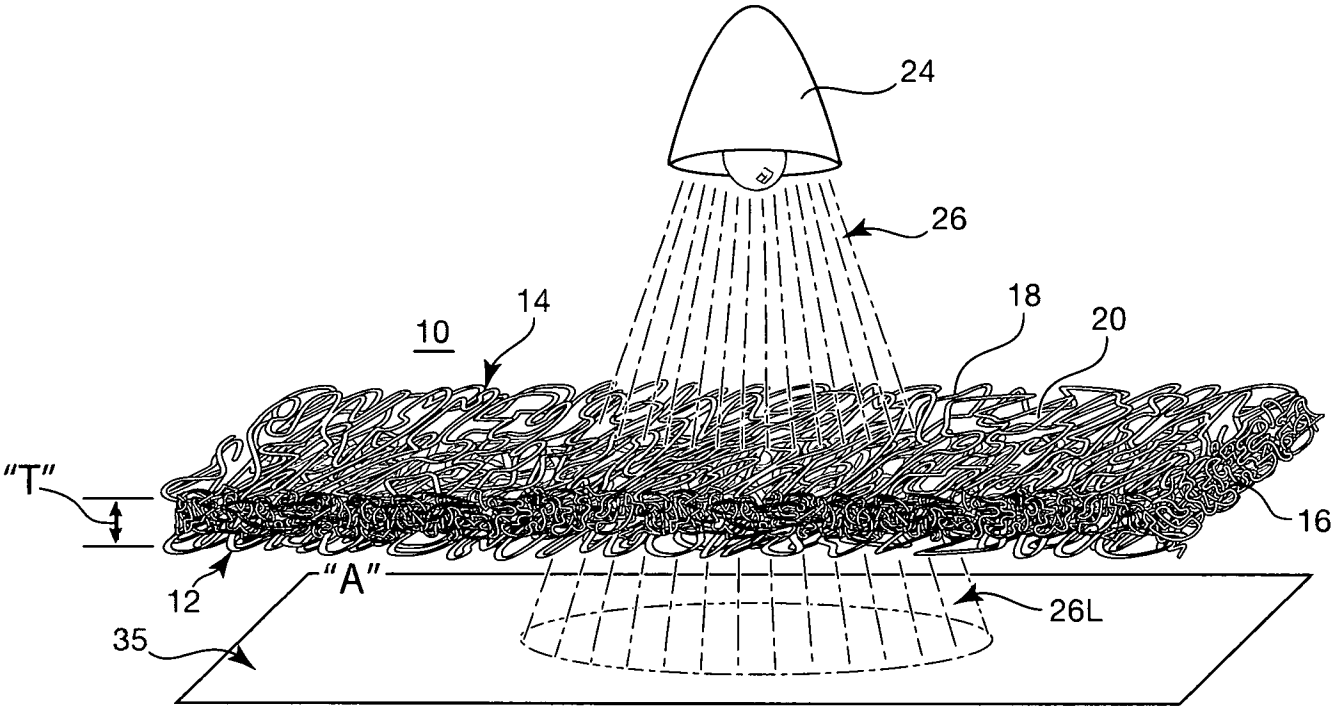
FIG. 3 is a view of the multi-layered fire resistant erosion control mat represented in FIGS. 1 and 2, depicting a critical light-transmissive "open area" non-dense construction criteria for such mat.

The elongated, flexible, fire-resistant upper netting 14 is also preferably comprised of a woven or roll-pressed or stamped, foraminous, porous, air and light transmissive layer of metal such as stainless steel, galvanized steel, aluminum, tin, or a fire resistant plastic or polyvinyl chloride material, as represented in FIGS. 2 and 3. Such upper netting 14 may also be comprised of a chain link (fence) type arrangement 18, having smaller openings 20 of a range of one quarter inch to one inch across.

The constructed mat assembly 10, as represented in FIGS. 1 and 3, has a preferable thickness "T" of about 0.1 to about 2.0 inches, and an open internal areas "A" (interstices) of zero to about 80 percent, preferably 30 to 80 percent, as measured by light transmissive or light transparency. A lamp 24 is shown in represented in FIG. 3 casting light rays 26 through the mat assembly 10, wherein 30 to 80 percent of those light rays 26 are allowed to pass all the way through, as 26L, onto a lower examination surface 35.

Figure 4:
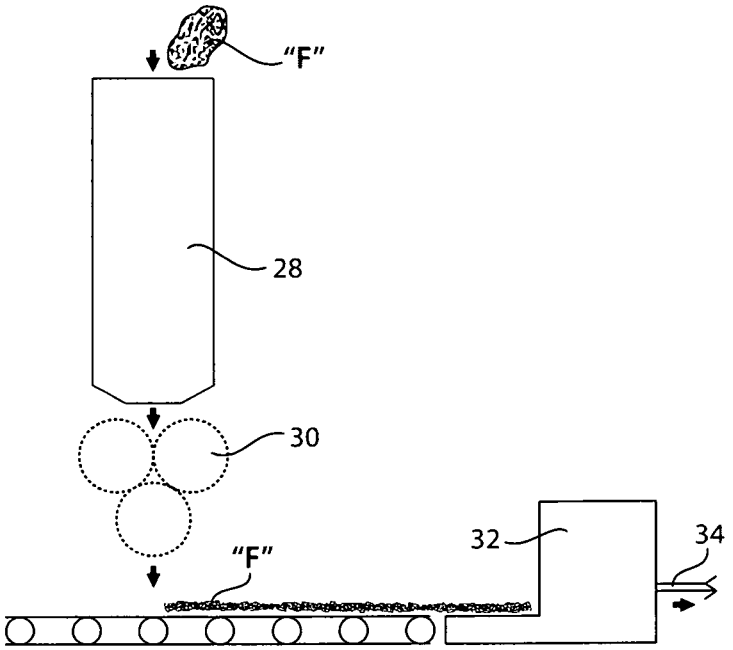
FIG. 4 is a schematic representation of the manufacture of the fibrous core material of the fire resistant erosion control mat, prior to its final step in the construction of the multi-layered fire resistant erosion control mat.

The elongated, fire-resistant, light and air penetrable inner layer 16 is comprised of an elongated fibrous matrix comprised preferably of a stone or rock wool material, such as for example, fiberized Basalt, a common treatable rock. Such a source fiber "F", meaning for example, Basalt or other rock adaptable wool, vegetation-supportive matrix, is processed into longer fiber by a melting/treating of the slag or mineral, through a treatment chamber 28, as represented in FIG. 4.

Figure 5:
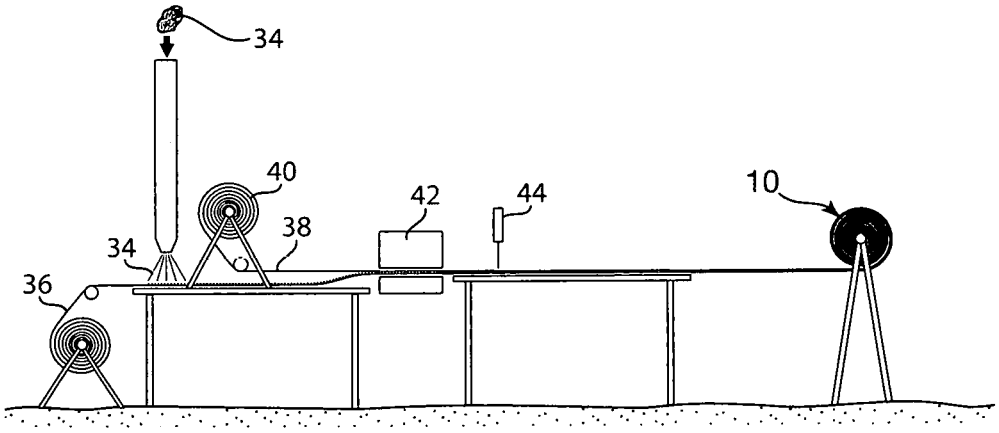
FIG. 5 is a schematic representation of the construction of the multi-layered fire resistant erosion control mat utilizing the fibrous core material depicted in FIG. 4.

This longer fiber is created by a grinding or milling roll arrangement 30 and spun or milled in a further chamber 32, so as to become a usable length of inner layer material 34. Those usable lengths of fire-resistant fiber 34 may be deposited as the inner layer on a fire-resistant lower web 36, and covered with an upper fire-resistant web 38 from a supply roll 40 as represented in FIG. 5, for the production of the fire-resistant mat assembly 10, after passing through a proper treatment works, such as an oven 42, wherein subsequently, treatment rollers, tack welding, stitching and binder application 44 are provided.

The upper and lower webs 14 and 12 in further embodiments may be comprised of for example, a wire mesh, synthetic extruded netting or synthetic yarn or a combination thereof, woven into a net. Such components are preferably fire resistant, for this particular embodiment, inasmuch as they initially contain and secure the inner layer for a sufficient length of time to establish proper ground positioning of the mat.

The source fiber "F" may be spun or otherwise processed into long yarns and used to replace the thread in a fire-resistant stitch bonded product. The source fiber may itself be spun or processed into long yarns and woven into a net that is utilized as a replacement for the upper and lower metallic earlier described netting, on a stitch bonded, tack welded or stapled multi-layered product. The source fiber may be spun into long yarns entangled or wrapped in conjunction with other components (steel mesh, synthetic mesh, etc) to form advantageous configurations of foraminous mats. The source fiber "F" may also be spun into long yarns woven into a continuous matrix or web that forms a three-dimensional array, absent fiber and stitching or inclusive of fiber and stitching.

Alternatively, such fiber matrix may be formed without either or both the upper and lower nets, by an adhesive binder, a thermoplastic resin, a heat welding, tack welding or heat treatment of the fibers "F" for insuring tacked fiber adhesion of the milled mineral wool or metallic wool (for example, steel wool) to one another at disparate locations thereon sufficient to form a flexible, ground-depositable layer of fire resistant, ground erosion minimizing protection, with or without either or both the upper and/or lower layer of fire-resistant or synthetic, or eventually degradable enclosure nets.

The fibers and yarns are preferably thicker and longer than the source fiber of the parent mineral wool. Dimensions may vary, however, are sufficient to develop a matrix, yarn or fiber to meet specification. Typically, the fill fiber has dimensions ranging from 0.01 inches to 0.1 inches thick and from 0.25 inches up to 12 inches in length. The finished yarn preferably ranges from 0.01 inches to 0.75 inches thick and from a few inches to tens of thousands of feet long.

The present inventive elongated mat is constituted by the Basalt or stone wool matrix and metalized or fire resistant upper and lower layers for long term enablement of sunlight to pass through, to resist the spread of fires, to reduce ground erosion, and especially to aid in the establishment.

The invention claimed is:

1. A fire resistant ground erosion control mat assembly comprised of:

an inner layer of fire resistant milled stone mineral wool material sandwiched between an upper layer supportive net and a lower layer supportive net, wherein the upper layer supportive net and the lower layer supportive net are each comprised of fire resistant milled mineral foraminous nettings to enable ground positioned emplacement of the inner layer of fire resistant milled stone wool material; wherein the inner layer of fire resistant milled stone mineral wool material is comprised of Basalt rock; wherein the fire resistant ground erosion control mat assembly is light transmissive all the way through to enable the fire resistant ground erosion control mat assembly to have a light projection analyzable open area from 30 to 80 percent, and wherein the Basalt rock of the inner layer of fire resistant milled stone mineral wool material is comprised of mineral wool fibers between 1 to 8 inches long and between 0.005 to 0.05 inches in diameter.

2. A fire resistant ground erosion control mat assembly comprised of:

an inner layer of fire resistant milled stone mineral wool material sandwiched between an upper layer supportive net and a lower layer supportive net, wherein the upper layer supportive net and the lower layer supportive net are each comprised of a fire resistant foraminous milled mineral to enable ground positioned emplacement of the inner layer of fire resistant milled stone mineral wool material, and wherein the inner layer of fire resistant milled stone mineral wool material is comprised of Basalt rock, and wherein the fire resistant ground erosion control mat assembly is light transmissive to enable a light projection analyzable open area from 30 to 80 percent therethrough, and wherein the upper layer supportive net and the lower layer of supportive net are each comprised of a chain link webbing, and wherein the inner layer of fire resistant milled stone mineral wool material is comprised of mineral wool fibers between 1 to 8 inches long and between 0.005 to 0.05 inches in diameter.

* * * * *